United States Patent [19]

Schrock et al.

[11] Patent Number: 4,996,726

[45] Date of Patent: Mar. 5, 1991

[54] ACCELERATED RIM WASH FOR A TOILET

[75] Inventors: Donald C. Schrock, Carmel, Ind.; David Nichols-Roy, Escondido, Calif.

[73] Assignee: Masco Corporation of Indiana, Taylor, Mich.

[21] Appl. No.: 343,970

[22] Filed: Apr. 26, 1989

[51] Int. Cl.[5] ..... E03D 1/00

[52] U.S. Cl. ..... 4/300; 4/331; 4/366; 4/367; 4/405; 137/403; 137/426

[58] Field of Search ..... 4/300, 331, 332, 366, 4/367, 374, 378, 405, 407, 420; 137/403, 441, 414, 426, 393

[56] References Cited

U.S. PATENT DOCUMENTS

| | | | |
|---|---|---|---|
| 1,971,880 | 8/1934 | Taylor | 4/331 |
| 1,985,120 | 12/1934 | Vogel | 4/423 |
| 2,034,173 | 3/1936 | Brooks | 4/423 |
| 3,086,217 | 4/1963 | Barlow | 4/367 |
| 3,585,646 | 6/1971 | Lopez | 4/343 |
| 3,932,901 | 1/1976 | Inui et al. | 4/332 |
| 4,094,327 | 6/1978 | Brandelli | 137/403 |
| 4,318,194 | 3/1982 | Pinkston | 4/366 |
| 4,341,238 | 7/1982 | Roosa et al. | 137/414 |
| 4,391,003 | 7/1983 | Talerico et al. | 4/415 |
| 4,402,093 | 9/1983 | Luker | 4/427 |
| 4,408,361 | 10/1983 | Rozek | 4/331 |
| 4,411,029 | 10/1983 | Huang | 4/324 |
| 4,419,772 | 12/1983 | Smith | 4/364 |
| 4,499,615 | 2/1985 | Radovsky | 4/366 |
| 4,574,826 | 3/1986 | Johnson | 137/426 |
| 4,646,779 | 3/1987 | Johnson | 137/426 |
| 4,700,413 | 10/1987 | Lopez | 4/324 |
| 4,760,612 | 8/1988 | Dufau | 4/225 |
| 4,764,995 | 8/1988 | Harney | 4/325 |
| 4,858,252 | 8/1989 | Johnson | 4/368 |
| 4,887,635 | 12/1989 | Johnson | 137/426 |

OTHER PUBLICATIONS

Sloan Royal Model Flush Valve (Photo), (date unknown).

*Primary Examiner*—Henry J. Recla
*Assistant Examiner*—Glenn T. Barrett
*Attorney, Agent, or Firm*—Myron B. Kapustij; Edgar A. Zarins; Malcolm L. Sutherland

[57] ABSTRACT

A fill valve (36) has a main valve (34) with a control chamber (44) for controlling the on and off actuation of the main valve. A tube (58) is in fluid communication with chamber (44) and extends into the water at the fill level (46) in tank (10). The flush valve (64) is connected to tube (58) such that upon actuation it raises tube (58) and lowers the pressure in chamber (44) to turn on the main valve (34) independent of whether the water level in tank (10) drops below its fill level (46) to direct water from the main valve to a rim wash conduit (28).

15 Claims, 3 Drawing Sheets

ACCELERATED RIM WASH FOR A TOILET

TECHNICAL FIELD

This invention relates to water closets and more particularly to a fill valve flush system for a water closet tank.

BACKGROUND OF THE INVENTION

In conventional water closet tanks, a flush valve is positioned near the bottom of the tank and is operable by a flush handle via chains or other mechanical linkages. As the flush valve is opened, the water within the tank drains through the flush valve opening. The water tank also includes a fill valve which often incorporates a float member such as a ball which floats on the water within the tank. Lowering of the water level within the tank lowers the ball to actuate or turn on the fill valve. When the flush valve closes and the tank is refilled, the ball then floats to its shut off position to shut off the fill valve. This system has long been used in water closets and provides for adequate flushing if there is adequate amount of water and water pressure from the tank to the bowl.

Rim flushes for one piece low profile water closets have a separate conduit leading directly from the fill valve to the rim wash ports about the upper perimeter of the bowl. The rim wash line is directly connected to the supply conduit because the low profile of the water tank relative to the bowl does not provide adequate water pressure to the rim ports at the upper perimeter of the bowl. A diverter mechanism is often provided to direct the water from the fill valve to flow through a rim wash conduit during the draining of the tank. When the tank is emptied and the flush valve closes, the diverter mechanism switches position to close off the rim wash conduit and directs water through a fill pipe (i.e. hush tube) that ends within the tank. The fill valve is actuated by the lowering of the water level within the tank. Operation of the flush handle opens the flush valve which allows draining of the water from the tank hence lowering of the water level within the tank.

Fill valves have also been devised which eliminate the use of ball cocks. These fill valves include an air pressure control chamber in which the rise in water level traps air within the chamber and causes it to be pressurized to shut off the valve mechanism in the fill valve. The main valve mechanism is opened when water in the control mechanism is drained as the water within the tank flows through the open flush valve. A fill valve of this type is described in detail in U.S. Pat. No. 4,574,826 and 4,646,779 issued to Dwight Johnson on Mar. 11, 1986 and Mar. 3, 1987, respectively. All teachings in the above mentioned patents are incorporated in this application by reference.

In tankless toilets, a flush valve handle directly operates and opens the flush valve for a certain period of time. These flush valves on tankless toilets are common in commercial and institutional settings. However, these valves need a water flow of about 25 gallons per minute to produce an adequate flush in the toilet bowl. Most residential water supply lines are incapable of supplying water at this high rate so tanks are incorporated in most residential toilets.

In low water consumption toilets which are becoming popular either by regulation or by commercial need, the amount of water within the tank is often under two gallons. Furthermore, the two gallons of water is flushed in a short six second period. This short period of time is often inadequate for the fill valve to actuate and let the water from the actuated fill valve to flow through the rim wash conduit to the rim ports and into the bowl to provide an adequate rim wash during the flush cycle.

What is needed is a tank for a toilet that provides a pressurized rim wash that simultaneously commences with the flush cycle. Furthermore, what is needed is a system which accelerates the actuation of the fill valve such that commencement of rim wash is accelerated relative to the draining of the water in the water tank so that an adequate rim wash occurs during the short flush cycle of the low water consumption toilet without the addition of separate valve mechanisms.

SUMMARY OF THE INVENTION

In accordance with one aspect of the invention, a toilet tank flushing system includes a fill valve operably mounted within the tank. The fill valve includes a main valve movable between an open and closed position and a control device for closing and opening the main valve. The control device desirably includes a control chamber which is responsive to a predetermined air pressure therein to open the valve when the pressure is below the predetermined amount and closes the valve when the pressure is above a predetermined amount. A tube has a first end connected with the control chamber and is in air pressure communication therewith. The tube has a second end normally positioned to be submerged in the tank liquid at the fill level of the tank. The second end is operably connected to the flush actuator, commonly a flush handle, such that upon actuation of the flush handle, the second end is raised to significantly increase the volume for the air in the chamber. Consequently, the air pressure is lowered therein. The control device responds to the lower air pressure and opens the main valve independent of any lowering of the liquid level in the tank.

In one embodiment the second end of the tube is connected to a volume expander member having an enlarged diameter to provide for a substantial change in volume as the enlarged diameter volume expander is partially raised above the fill level of the water tank to increase the volume for the air pressure chamber. The lower open end of the volume expander remains below the water level to provide a seal from ambient atmosphere during normal operation of the flush handle.

In one embodiment, the tube has a second end which is raised above the fill level in the water tank to allow the air pressure within the chamber to be in communication with the ambient atmosphere and to allow the chamber to lower its pressure down to ambient atmosphere and thus turn on the main valve independently of lowering the water from the fill level in the tank.

More broadly, the invention relates to a toilet tank flushing system that has a fill valve operably mounted within the tank. The fill valve is movable between an open and closed position. A device for closing the fill valve is responsive to the predetermined level of water in the tank. The fill valve is actuated by the flush actuator and is actuated independently of lowering water from the fill level in the tank.

Another aspect of the invention relates to a tank fill valve that is operable between an open and closed position with a control device for closing and opening the fill valve. A device for causing the control mechanism to open the fill valve independently of any lowering of water from the fill level of the tank is also incorporated into the fill valve.

Another aspect of the invention relates to a tank for a toilet that has a fill valve and means for actuating a rim wash independently of lowering of the water level in the tank.

The actuation of the fill valve independent of lowering of the water tank allows for the acceleration of the rim wash cycle with respect to the flush cycle and to provide for an adequate rim wash of the bowl without the necessity of additional valve mechanisms.

BRIEF DESCRIPTION OF THE DRAWINGS

Reference now will be made to the accompanying drawings in which.

DETAILED DESCRIPTION OF THE PREFERRED EMBODIMENTS

Figure 1:
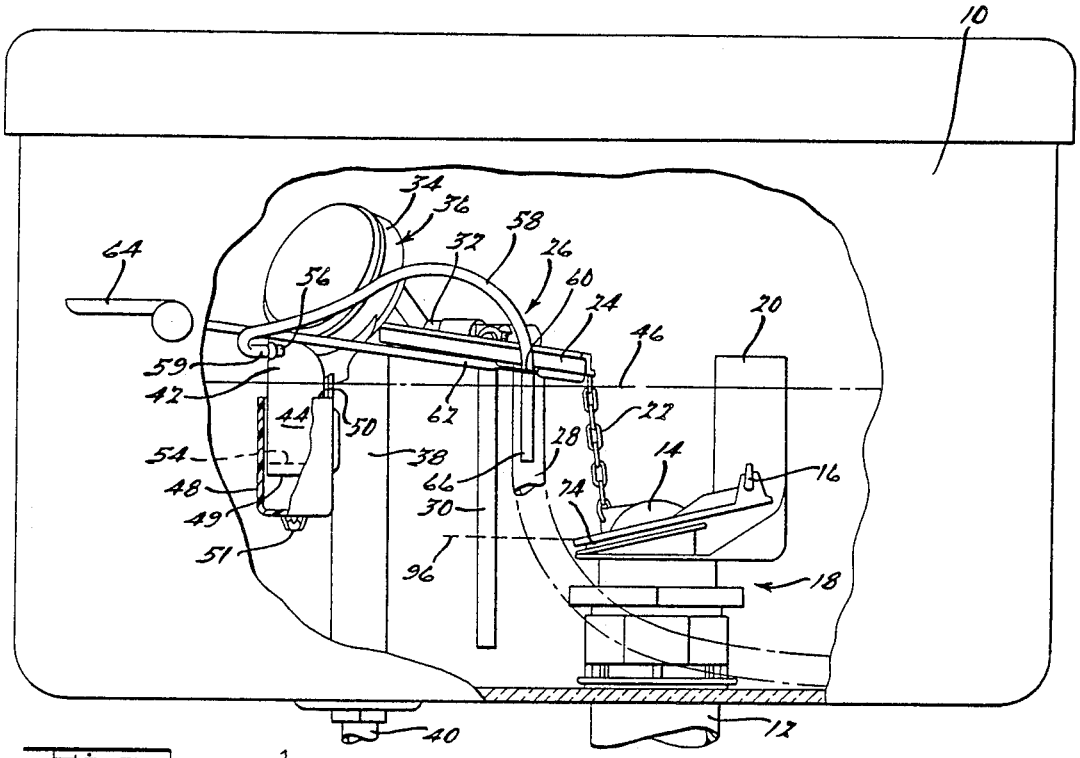
FIG. 1 is a front elevational and partially segmented view of a toilet tank in accordance with one embodiment of the invention showing the valve in the off position and the toilet tank in the filled mode.

Referring to FIG. 1, a toilet tank 10 has a flush outlet 12 at the bottom thereof. A flush valve 18 incorporates a flapper 14 that is mounted for pivotal movement onto prongs 16. The flush valve seat assembly 18 has a conventional overflow pipe 20. The flush valve 14 is connected via chain 22 to a diverter assembly 26 of the type found in U.S. Pat. No. 4,318,194 issued to David L. Pinkston on Mar.9, 1982. The teachings of this patent are hereby incorporated by reference; particularly a section of the Detailed Description from column 2, line 15 to column 3, line 16 and the accompanying drawings. The diverter 26 has one outlet connected to a rim wash conduit 28 and a refill pipe 30 commonly called a hush pipe. Its inlet 32 is connected to a main valve section 34 of fill valve assembly 36 which is of the type disclosed in previously mentioned U.S. Pat. No. 4,574,826 to Johnson which is also incorporated herein by reference; particularly the section from column 5, line 1 to column 9, line 68 and the accompanying drawings.

The main valve section 34 sits on top of a stem section 38 which is operably connected to a supply conduit 40. The main valve 34 is controlled by a diaphragm as taught by the Johnson patent which is in communication with the probe 42 that is cylindrical and hollow and forms a control chamber 44. The probe extends downward to substantially below the fill level as indicated by line 46. An optional cup member 48 is attached to the bottom of the probe and forms an open inlet 50 as disclosed and claimed in a recently filed copending patent application by Dwight Johnson and commonly assigned with the present application.

The control diaphragm is responsive to pressure in chamber 44 which corresponds to compression of air resulting from a rise of liquid from the bottom 49 of probe 42 to a response level as indicated by line 54. In turn, response level 54 is achieved by water at the fill level 46 flowing through opening 50 in cup 48 to chamber 44.

The probe 42 has a nozzle 56 which connects to a tube 58 which extends through an opening 60 of actuator arm 62 that is connected to a flush handle 64. The tube 58 is secured through the opening 60 in arm 62 and has an end section 66 normally submerged under fill level 46. The tube is hollow and is in fluid communication through nozzle 56 with chamber 44. The tube is made from a semi-flexible material such as vinyl or ethylene propylene.

Figure 2:
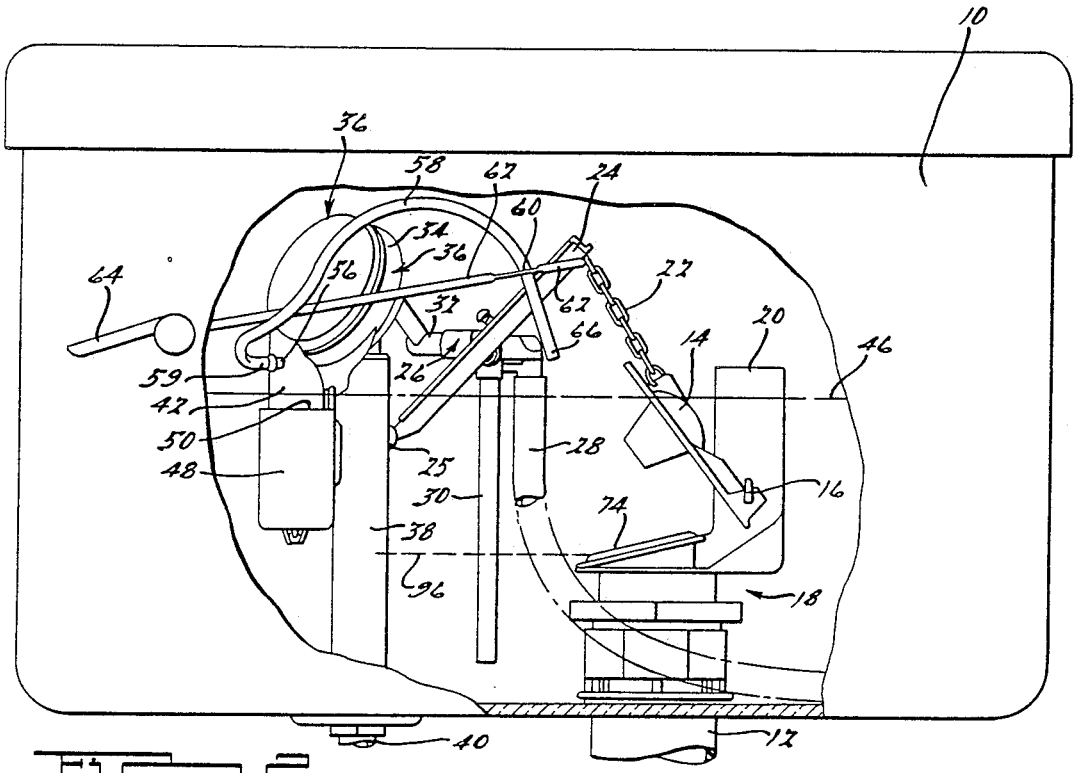
FIG. 2 is a view similar to FIG. 1 showing the main valve in the on position and the flush valve opened.

As shown in FIG. 2, the handle 64 can be operated so that it pivots and causes actuator arm 62 to pivot upwardly. The upward motion of the actuator arm 62 causes lower end 66 to lift up above fill level 46 and expose the end 66 and chamber 44 to ambient atmosphere. Control chamber 44 consequently loses its elevated pressure and the lower pressure causes the control diaphragm to open the main valve section 36.

Simultaneously actuate arm 62 pivots diverter arm 24 upwardly which in turn pulls the flapper 14 to its open position as shown in FIG. 2 via chain 22. The weight 25 on arm 24 opens the passage to rim wash conduit 28. The main valve 34 is open and water then flows through the inlet 32 and through rim wash 28.

Figure 3:
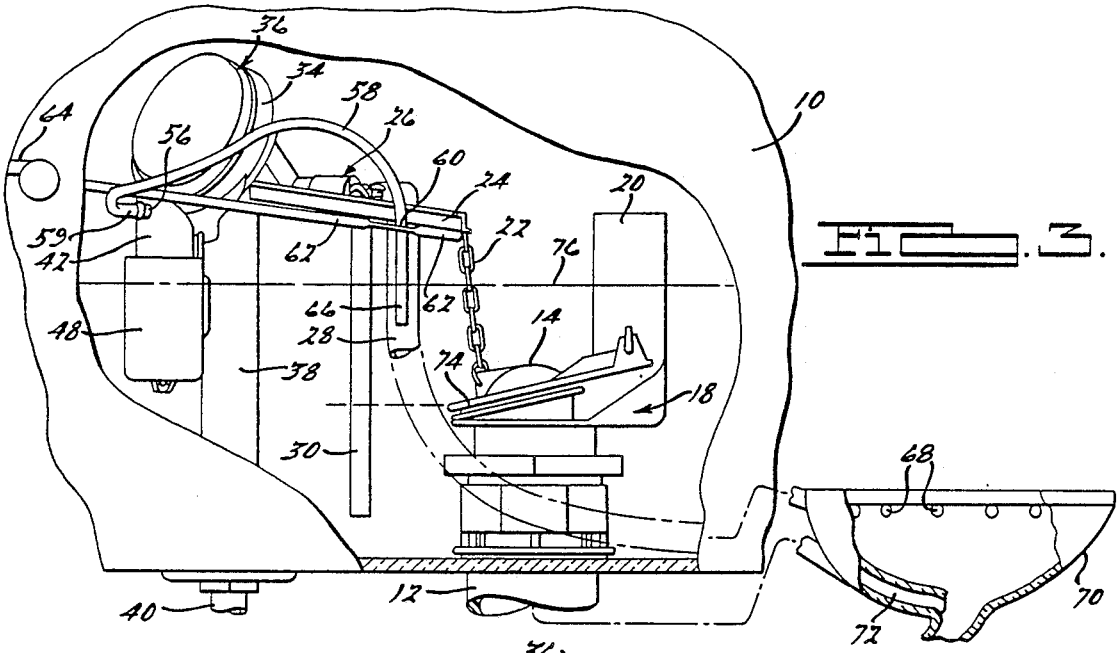
FIG. 3 is a view similar to FIG. 2 showing, in schematic, the attachment of the tank outlet to the bowl and the rim wash conduit to the rim port with the toilet tank being in the refilling mode.

Referring now to FIG. 3, the rim wash conduit 28 is connected to a plurality of ports 68 about bowl 70. The flush valve passageway 12 is connected to a jet way 72 directed toward the bottom portion of bowl 70. Referring back to FIG. 2, it could be seen that the rim wash via conduit 28 and port 68 is started simultaneously with the water within the tank 10 flowing through outlet 12 and before the water is lowered from fill level 46. The main valve 34 stays on even after flush handle 64 is released and actuating arm 62 under its own weight pivots the handle 64 back to the position shown in FIG. 1. The flapper 14 due to its buoyancy is maintained in position shown in FIG. 2 until the water drains through the flush valve 18 and discharge outlet 12. Meanwhile the water within cup 48 drains through a check valve 51 at the bottom thereof.

When the water is lowered beyond the bottom end of cup 48 and near the valve seat rim 74 at level indicated by 96, the flapper 14 closes onto the rim 74 to close the flush valve 18. The closing of flush valve 18 pulls the arm 24 via chain 22 back to the position shown in FIG. 3. The diverter assembly 26 now directs water through the hush pipe 30 to refill the tank as shown in FIG. 3 past level 76. The lower end 66 of tube 58 is now sealed within the water in tank 10. Water continues to refill the tank to the fill level 46 shown in FIG. 1 at which point the chamber 44 becomes repressurized due to the fact that lower end 66 is now sealed within the water in tank 10 and water flows through opening 50 into the control chamber 44. At this point the tank achieves the ready mode as shown in FIG. 1 and is ready for another flush.

Figure 4:
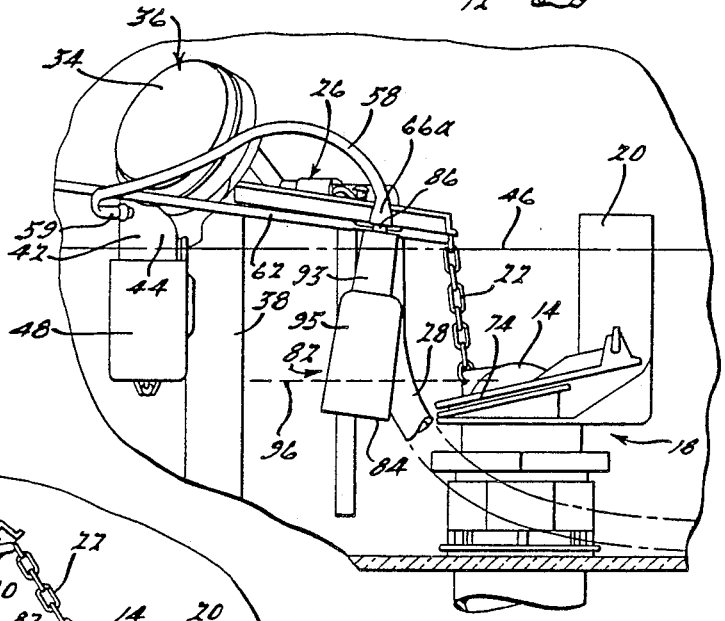
FIG. 4 is a fragmentary view of a toilet tank showing an alternate embodiment of the invention with the toilet tank in the filled mode.
Figure 5:
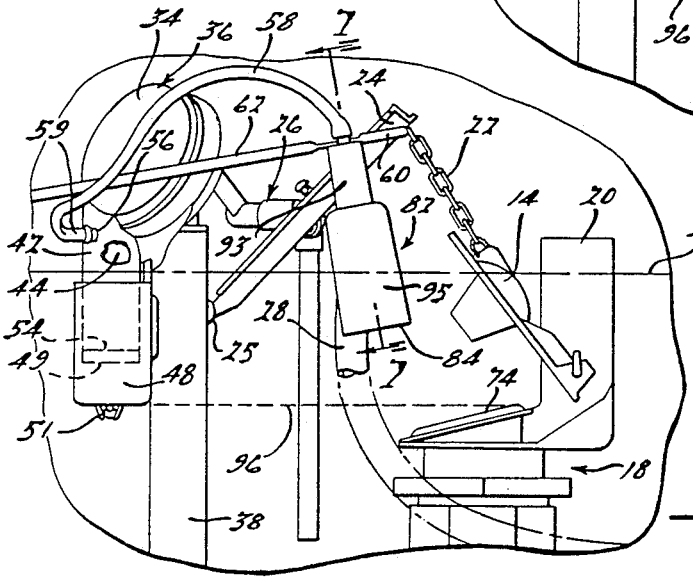
FIG. 5 is a view similar to FIG. 4 showing the main valve in the on position and the flush valve opened.
Figure 6:
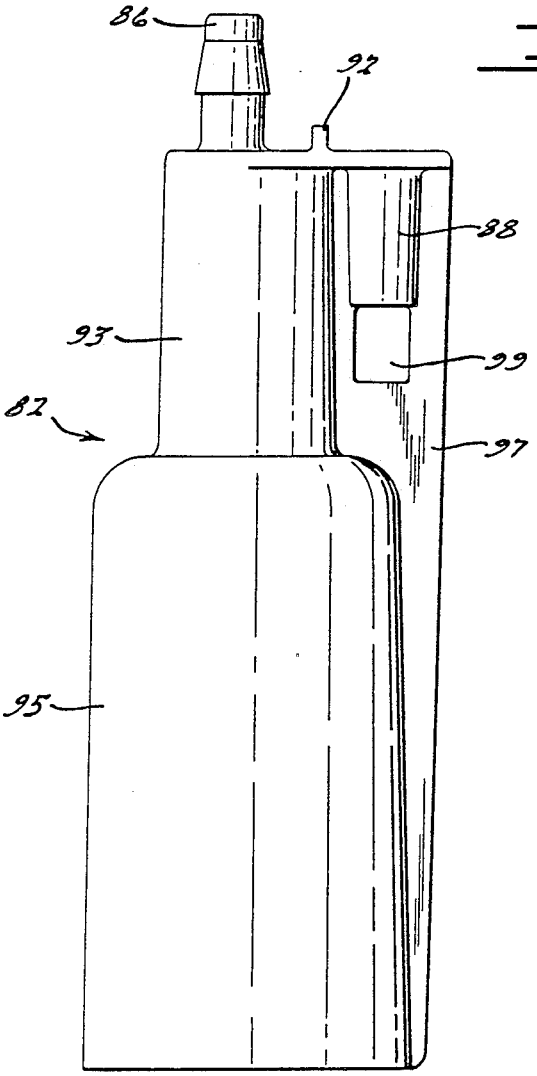
FIG. 6 is an enlarged side elevational view of the volume expander shown in FIG. 4.
Figure 7:
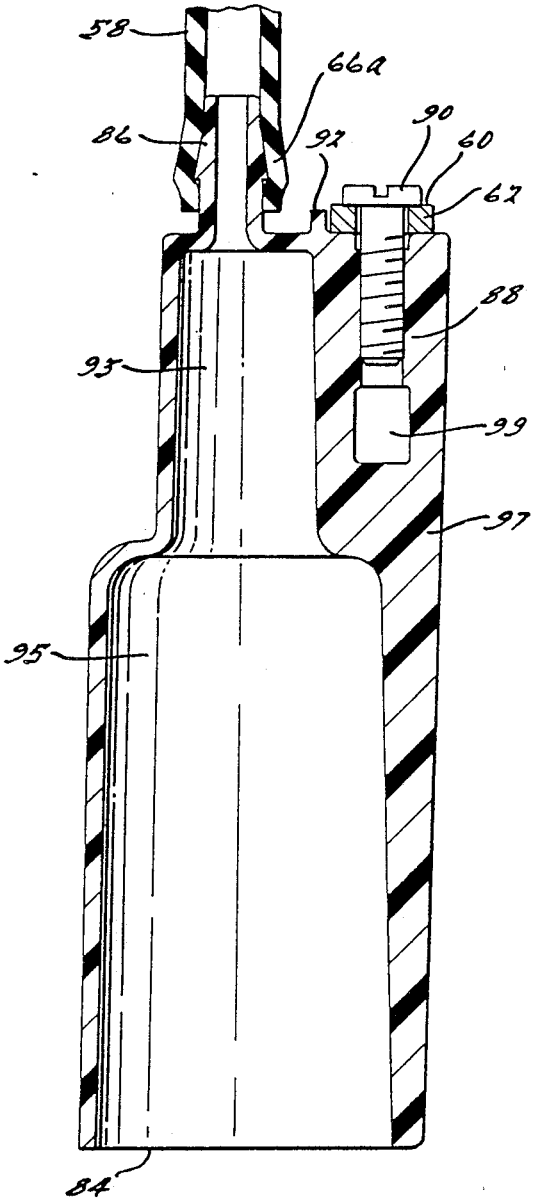
FIG. 7 is an enlarged cross sectional view taken along the lines 7—7 in FIG. 5.

An alternate embodiment is shown in FIGS. 4 and 5 wherein the tube 58 has its end **66*a* connected via a nozzle fitting 86 to an enlarged volume expander member 82 having an increased diameter. The expander has a lower open end 84 and an upper nozzle fitting 86**. The fitting 86 sealingly fits second end 66*a* of tube 58. As shown more clearly in FIGS. 6 and 7, the volume expander 82 made from a rigid plastic such as polyolefin has a threaded receptor section 88 capable of receiving a fastener 90 through hole 60 in arm 62. A shoulder 92 is adjacent the threaded receptor 88 and positioned to abut the edge of arm 62 to prevent rotation of member 82 with respect to arm 62. The member 82 has a transition section 93 and an enlarged bell section 95 directly leading to the open end 84. A support rib 97 reinforces the connection of the laterally disposed receptor section 88 with the transition section 93 and bell section 95 to provide a rigid member. Aperture 99 is below receptor section 88 in rib 95 to allow the use of longer screws to pass through section 88. The enlarged section 95 is completely submerged below fill level 46 in the normal off position. The open end 84 is normally below flush rim 74.

Upon operation of the flush handle 64 as shown in FIG. 5, the tube 58 is raised such that enlarged section 95 becomes partially placed above fill level 46 such that a substantial increase in effective chamber volume occurs above water level 46 to decrease the pressure within chamber 44 of probe 42. Even though the open end 84 does not become exposed to the ambient air, the pressure within chamber 44 drops a sufficient amount to turn on the main valve 34. The actuation of flush handle 64 and the raising of lower section 82 provides for the main valve 34 to turn on even before the level of water within tank 10 is lowered from the fill level 46.

The flush handle 64 is normally released soon after actuation such that the arm 62 swings back to the position shown in FIG. 4. The volume expander member 82 is also dropped with the release of flush handle 64. The lower end 84 is thus positioned below valve seat rim 74 and is always submerged within water in the tank 10. As the tank 10 is refilled when flush valve 14 is closed, the water then refills bell section 95 and the air within tube 82 will back up through chamber 44 and pass out from under now open end 49 of probe 42. As water reaches the fill level 46, it flows through cup 50 to shut off the main valve 34 by increasing pressure in chamber 44. The volume expander 82 does not significantly affect the air pressure control during the shutting off operation since the expander is substantially submerged in water.

It is noted that the volume of air in tube 58 and upper end of transition section 93 is relatively minor compared with the volume of air in chamber 44. Therefore the response levels 54 in chamber 44 are substantially the same and do not substantively change the shut off operation relative to a valve that did not have tube 58.

Both of the described embodiments allow for the main valve 34 to turn on before the water level drops from the fill position 46. Extra time is provided for water from the main valve 34 to pass through the rim wash conduit 28 under line pressure to a rim port 68. An adequate rim wash is actuated independently from a drop in the tank water level. By elimination of the need for water in the tank to drop a significant degree and waiting for the main valve 34 to be actuated by a drop in the water level, the rim wash gets the needed water at an accelerated time frame relative to conventional flush valve systems. The early rim wash before the drop of the tank water level provides for a more efficient use of the water through the rim and provides for a cleaner bowl after each flush. With this rim wash system and using an accelerated main valve actuation, adequate flushes with as little as 1.6 gallons of water are possible without the necessity of using special air sealed tanks, extra valves, or other electrical accessories that have been found in more exotic and cumbersome water saving toilets. Further, a low profile tank situated substantially behind the bowl can also be used with the above described instant on fill valve.

It should be noted that the described fill valve incorporates a control chamber that operates on air pressure. It is also foreseen that mechanical actuation of a fill valve that incorporates floats to turn off the fill valve is also possible. It is also foreseen that other valves besides a fill valve may be used to direct water to the rim wash.

Variations and modifications of the present invention are possible without departing from the scope and spirit as defined in the appended claims.

The embodiments in which exclusive property and privilege is claimed are defined as follows:

1. A flushing system for a toilet tank comprising:

a fill valve operably mounted within a tank comprising:

a main valve connected to a source of liquid and movable between an open and closed position, said main valve allowing flow of liquid to fill said tank when open and preventing flow of liquid to the tank when closed, control means for closing and opening said main valve of said fill valve, said control means responsive to air pressure in a control chamber which corresponds to a predetermined fill level of liquid in said tank for closing or opening said main valve, means for causing said control means to open said main valve upon actuation of a flush actuator being constructed to lower air pressure within said control chamber a sufficient amount independently of the level of liquid within said tank to cause said control means to respond thereto and open said main valve;

a flush valve to control the passage of liquid from the tank to a bowl;

a rim wash conduit connectable to a rim wash port about said bowl;

a diverter having a first outlet connected to an upstream end of said rim wash conduit, a second outlet connected to a refill conduit in said tank, and an inlet in fluid communication with said main valve;

said flush actuator connected to said flush valve, said diverter, and said means for causing said control means to open said main valve such that upon actuation of said flush actuator said main valve opens independently of the level of liquid with said tank, said flush valve opens, and said diverter causes said liquid from said open main valve to pass through said rim wash conduit.

2. A toilet tank flushing system as defined in claim 1 further comprising:

said means for causing said control means to open said main valve including a tube having a first end fluidly connected with said control chamber for air pressure communication therewith, said tube having a second end normally positioned to be submerged in liquid at a fill level in said tank;

said second end being operably connectable to said flush actuator to raise said second end such that volume for said air pressure in said chamber substantially increases to lower air pressure therein and causes said control means to respond to said lower air pressure to open said main valve.

3. A toilet tank flushing system as defined in claim 2 further comprising:

said second end having an enlarged section of increased diameter;

said enlarged section normally positioned to be at least substantially submerged in liquid in a toilet tank;

said enlarged section being operably connected to said flush handle to be upwardly movable by actuation of said flush handle to expose a significant portion of said enlarged portion above the level of said fill level in said toilet tank a sufficient amount to increase an effective volume of said control chamber above said liquid and thus lower said air pressure therein a sufficient amount to cause said control means to respond to said lower air pressure and to open said main valve.

4. A toilet tank flushing system as defined in claim 3 further comprising:

said enlarged diameter section including a volume expanding member being operably connected to said tube and fastened to said flush actuator.

5. A toilet tank flushing system as defined in claim 4 further comprising:

said volume expanding member having a nozzle fitting for connection to said tube, an enlarged bell section positioned therebelow, and a transition section interposed therebetween and positioned at the fill level of said tank.

6. A toilet tank flushing system as defined in claim 5 further comprising:

said volume expanding member having a fastener receptor section laterally positioned from said nozzle fitting, and an enlarged bell section for receiving a fastener that connects said volume expander section to said flush actuator.

7. A toilet tank flushing system as defined in claim 2 further comprising:

said opening means including a tube having a first end connected with said control chamber for air pressure communication therewith;

said tube having a second end normally positioned to be submerged in liquid within a tank;

said second end operably connectable to said actuation means to raise said second end above said liquid to change the air pressure within said control chamber and tube to an ambient atmospheric level and to cause said control means to respond to said ambient atmospheric level and open said main valve.

8. A fill valve for a tank flushing system comprising:

a main valve connected to a source of liquid and operable between an open and closed position, said main valve allowing flow of liquid to fill the tank when open and preventing flow of liquid to the tank when closed;

control means for closing and opening said main valve;

control chamber in fluid communication with said control means, and air pressure within said control chamber being responsive to the level of liquid within the tank;

control means being responsive to the air pressure within said control chamber to close or open said main valve;

an opening means operably connectable to an actuation means for lowering the air pressure within said chamber upon actuation of said actuation means to open said main valve independently of the level of liquid within the tank;

said opening means includes a tube having a first end connected with said control chamber for air pressure communication therewith;

said tube having a second end normally positioned to be submerged in liquid in a filled tank; and said second end operably connectable to said actuation means to raise said second end such that the effective volume of said air pressure in said chamber substantially increases to lower air pressure therein such that said control means responds to said lower air pressure and opens said main valve.

9. A fill valve as defined in claim 8 further comprising:

said second end having an enlarged section of increased diameter;

said enlarged section normally positioned to be at least substantially submerged in liquid in a toilet tank;

said enlarged section being upwardly movable by actuation of said flush handle to expose a significant portion of said enlarged section above the level of said liquid in said toilet tank a sufficient amount to increase the effective volume of said control chamber and said tube above said liquid, and thus lower said air pressure therein a sufficient amount such that said control means responds to said lower air pressure and opens said main valve.

10. A fill valve as defined in claim 9 further comprising:

said opening means including a tube having a first end connected with said control chamber for air pressure communication therewith;

said tube having a second end normally positioned to be submerged in liquid in a tank;

said second end operably connectable to said actuation means to raise said second end above said liquid to change the air pressure within said control chamber and tube to an ambient atmospheric level such that said control means responds to said ambient atmospheric level and opens said main valve.

11. A volume expander member for a fill valve, said member comprising:

a nozzle fitting section for sealing connection to a tube;

an enlarged bell section having a lower open downwardly facing end;

a transition section between said nozzle and bell section and positionable at a fill level of a tank;

a fastener means section laterally disposed relative to said nozzle transition and bell section for fastening onto a flush actuator member.

12. A flushing system for a toilet tank comprising:

a fill valve including a main valve connected to a source of liquid, operably mounted within a tank and movable between an open and closed position, and control means responsive to the liquid level in said tank for opening or closing said main valve, said main valve allowing flow of liquid to fill said tank when open, said main valve preventing flow of liquid to said tank when closed;

a flush valve for directing liquid from said tank to a waterway leading to a toilet bowl;

said flush valve operable between closed and open positions;

a rim wash conduit in fluid communication with said main valve and to a rim wash exit means at an upper portion of said toilet bowl;

rim wash valve means operably connected to said rim wash conduit;

actuation means for opening said flush valve;

means for opening said main valve and actuating said rim wash valve means, to supply liquid from said main valve to said rim wash conduit independent of the level of liquid in said tank.

13. A flushing system as defined in claim 12 further comprising:

said actuation means for opening said flush valve including a manually operable flush actuator;

said means for actuating said rim wash valve means includes said manually operable flush actuator;

said means for actuating said rim wash valve means also includes said manually operable flush actuator operably connected to said valve means such that upon actuation of said flush actuator, said valve means provides liquid to said rim wash conduit.

14. A flushing system as defined in claim 13 wherein said valve means being responsive to an elevated air pressure in a control chamber;

means for causing said control chamber to open said valve means being constructed to lower air pressure in said control chamber; said means being operably connected to said flush actuator.

15. A flushing system as defined in claim 13 wherein said valve means includes said fill valve;

said fill valve includes a control chamber and is responsive to an elevated air pressure in said control chamber;

means for causing said control chamber to open said fill valve being constructed to lower air pressure in said control chamber, said means being operably connected to said flush actuator.

* * * * *